US007908831B1

(12) United States Patent
Dugan

(10) Patent No.: US 7,908,831 B1
(45) Date of Patent: Mar. 22, 2011

(54) STRETCH WRAP ROPE CONVERTER AND WRAPPING SYSTEM

(76) Inventor: Michael E. Dugan, Morrisville, PA (US)

( * ) Notice: Subject to any disclaimer, the term of this patent is extended or adjusted under 35 U.S.C. 154(b) by 0 days.

(21) Appl. No.: 11/986,825

(22) Filed: Nov. 27, 2007

(51) Int. Cl.
*B65B 53/00* (2006.01)
*B65B 41/12* (2006.01)
*B65B 11/04* (2006.01)

(52) U.S. Cl. ..... 53/587; 53/211; 53/218; 53/389.2; 53/441; 53/556

(58) Field of Classification Search ..... 53/209, 53/211, 218, 441, 449, 556, 587, 588, 389.2, 53/370
See application file for complete search history.

(56) References Cited

U.S. PATENT DOCUMENTS 2,026,282 A * 12/1935 Leguillon ..... 206/451
3,807,132 A * 4/1974 Kamiya ..... 53/204
4,204,377 A 5/1980 Lancaster et al.
4,235,062 A 11/1980 Lancaster, III et al.
4,255,918 A 3/1981 Lancaster et al.
4,754,594 A 7/1988 Lancaster
4,807,427 A * 2/1989 Casteel et al. ..... 53/556
4,845,920 A 7/1989 Lancaster
5,031,771 A * 7/1991 Lancaster ..... 206/442
5,447,009 A * 9/1995 Oleksy et al. ..... 53/399
5,463,843 A * 11/1995 Sharp ..... 53/399
5,515,973 A 5/1996 Sharp
5,531,061 A * 7/1996 Peterson ..... 53/526
6,185,900 B1 2/2001 Martin et al.
6,185,914 B1 2/2001 Mackie
6,189,291 B1 2/2001 Martin et al.
6,293,074 B1 9/2001 Lancaster, III et al.
6,550,222 B2 4/2003 DeGrasse
6,594,970 B1 7/2003 Hyne et al.
6,729,106 B2 5/2004 Wiley
6,745,544 B2 * 6/2004 Matsumoto et al. ..... 53/399
6,874,297 B2 * 4/2005 Solis et al. ..... 53/399
6,925,778 B2 * 8/2005 Suolahti ..... 53/399
6,955,027 B2 * 10/2005 Suolahti ..... 53/141
6,971,220 B1 * 12/2005 Rampp ..... 53/441

* cited by examiner

*Primary Examiner* — Paul R Durand
(74) *Attorney, Agent, or Firm* — Kenneth P. Glynn

(57) ABSTRACT

A stretch wrap rope converter and wrapping system includes: a.) a wrapping apparatus having: (i) a frame for movement of a carriage; (ii) the carriage moveably mounted to the frame and adapted to hold at least one rotatable roll of stretchable film material thereon and being adapted to generate two separate streams of film therefrom; (iii) drive mechanism connected to the carriage; (iv) a stretch wrap rope converter functionally connected to the carriage so as to receive the first stream of film and the second stream of film, the converter having a first orifice for diminishing the first film to create a first rope, and having a second orifice for diminishing the second film to create a second rope, and having rope rotation mechanism so as to rotate the first orifice and the second orifice through an arc in either a reciprocal fashion and/or a circular fashion to cause the first rope and the second rope to move toward, cross and then away from one another; b.) wrapping target rotation mechanism adapted to rotate either the wrapping apparatus and a wrapping target so the first rope and the second rope engage the wrapping target during rotation.

20 Claims, 5 Drawing Sheets

STRETCH WRAP ROPE CONVERTER AND WRAPPING SYSTEM

BACKGROUND OF INVENTION a. Field of Invention

The invention relates generally to stretch wrapping loads, such as stacked boxes and the like. More specifically, it relates to a converter and wrapping system wherein the film is converted from sheet to rope before engaging loads to be wrapped.

b. Description of Related Art

The following patents are representative of wrapping devices and systems:

U.S. Pat. No. 6,874,297 B2 to Solis et al. describes an apparatus and method for wrapping a load under tension with a web of stretch wrap flexible material and then binding the wrapping material to the load by compressing the end of the flexible material into a rope-like configuration. The rope formed is wound around the load at least one turn. A second turn of the rope around the load is then bound to the first rope with a mechanical twisting tie around the two ropes to prevent unwrapping of the load during transit and storage. A hot wire cutting mechanism cuts the rope and the bound two ropes snap back into position against the wrapped load from the force of the stretch wrap tension.

U.S. Pat. No. 6,729,106 B2 to Wiley describes a stretch-wrapping machine which consists of a revolving ring with a packaging material dispenser mounted to it. The ring revolves about a horizontal axis to dispense the stretch wrap material around a load that is supported by a forklift. The revolving ring is mounted on a track that allows the ring to travel back and forth in a direction perpendicular to the ring. This allows the machine to wrap any load that fits within the ring. This allows the machine to wrap any load that fits within the ring. Thus the length and the weight of the load do not limit the wrapping capability of the machine.

U.S. Pat. No. 6,594,970 B1 to Hyne et al. describes a method and apparatus for wrapping a loop of film about a pallet, which supports a layer of products, and a guide, through which said layer passes, to prevent crushing and/or displacement of the product layer. Subsequent product layers are similarly protected by looping film about a previous loop of film and said guide. The guide is designed to facilitate removal of the film looped thereabout as the product layers are lowered.

U.S. Pat. No. 6,550,222 B2 to DeGrasse describes a top platen device used to maintain stability in loads while the load is wrapped for shipping. The top platen device applies a compressive force to the load to stabilize the load while it is being wrapped. The top platen includes a shaft supporting platen pad which is placed on top of the load. The shaft and platen pad are configured to rotate eccentrically with respect to the geometric center of the top platen in order to rotate with the load about the load's center of rotation.

U.S. Pat. No. 6,293,074 to Lancaster, III et al. describes a leading end of packaging material which is attached to a retainer to hold the leading end of the packaging material as the retainer moves toward the load. The retainer is positioned adjacent the load and packaging material is dispensed from a packaging material dispenser, and relative rotation is provided between the dispenser and a load to wrap packaging material around the load. The packaging material is released from the retainer in response to force applied to the retainer to withdraw it from the wrapped load.

U.S. Pat. No. 6,189,291 to Martin et al. describes a leading end of packaging material grasped in a packaging material holder while a load is wrapped. Packaging material is dispensed from a packaging material dispenser, and relative rotation is provided between the dispenser and a load to wrap packaging material around the load. The packaging material holder is positioned on the rotating surface of a turntable but is isolated from any electrical or fluid power source of a rotatable surface of the turntable. During the wrapping cycle, a spring builds and stores energy as the packaging material holder moves downstream along the turntable, automatically releasing the leading end of the packaging material and automatically grasping a trailing end of the packaging material. At least a portion of the packaging material is cut between the packaging material holder and the load, and the spring releases the stored energy to move the packaging material holder upstream toward the dispenser.

U.S. Pat. No. 6,185,914 B1 to Mackie describes a pre-stretch wrapping device consisting of a base, a pre-stretch station, a vertical drive, and a rotatable load causes a pre-stretched web to become wrapped around the load under controlled tension. The pre-stretch station comprises a pair of pre-stretch rollers located on a pivotal frame, a spring which opposes the pivotal movement of the frame relative to the base, a roller motor, and a sensor located between the frame and the base. The sensor monitors relative movement of the frame from the base and a controller in response to signals from the sensor controls the operation of the roller motor.

U.S. Pat. No. 6,185,900 B1 to Martin et al. describes a leading end of packaging material grasped in a packaging material holder while a load is wrapped. Packaging material is dispensed from a packaging material dispenser, and relative rotation is provided between the dispenser and a load to wrap packaging material around the load. The packaging material holder is positioned on the rotating surface of a turntable but is isolated from any electrical or fluid power source of a rotatable surface of the turntable. During the wrapping cycle, a spring builds and stores energy as the packaging material moves downstream along the turntable, automatically releasing the leading end of the packaging material and automatically grasping a trailing end of the packaging material. At least a portion of the packaging material is cut between the packaging material holder and the load, and the spring releases the stored energy to move the packaging material holder upstream toward the dispenser.

U.S. Pat. No. 5,515,973 to Sharp describes a system of wrapping and securing together the components of a bulk package including a bottom tray element and a top cap element with an integral web of plastic material. The plastic material, while in a rope-like configuration, is looped about only a single pair of diagonally opposed corners of each of the top cap element and bottom tray element. The tail or terminal end of the web is secured in place by being positioned between a wrap convolution and the bulk package.

U.S. Pat. No. 5,031,771 to Lancaster describes a wrapping apparatus having a frame, a reciprocally driven carriage moveably mounted on the frame, the carriage being adapted to hold a rotatable roll of stretchable film material and a film width varying mechanism. A driven rotatable turntable adapted to support a load is positioned adjacent to the frame, and the leading edge of the film material is held adjacent to the load. A brake is connected to the film roll to restrict movement of the web of material from the roll and the film width varying mechanism is mounted in the material path so that the film web travels through a pivotable "C" shaped assembly of the film width varying mechanism to collapse the film web width so that the web edges are formed into rope configurations connected by a membrane of film. The carriage is driven along the frame in one direction to provide a wrap, stops when the sensing mechanism on the carriage indicates that a junction between units on the load is present to deposit the stretched collapsed film web so that each roped edge is placed on an adjoining vertically positioned unit with the membrane connecting the two units. The carriage carries the film roll to the next or subsequent junctions where the wrap cycle is repeated until the package wrap is complete, at which time the material web is severed from the material roll dispenser.

U.S. Pat. No. 4,845,920 to Lancaster describes a wrapping apparatus having a frame, a reciprocally driven carriage moveably mounted on the frame, the carriage being adapted to hold a rotatable roll of stretchable film material and a film width varying mechanism. A driven rotatable turntable adapted to support a load is positioned adjacent to the frame, and the leading edge of the film material is held adjacent the load. A brake is connected to the film roll to restrict movement of the web of material from the roll and the film width varying mechanism is mounted in the material path so that the film web travels through a pivotable "C" shaped assembly of the film width varying mechanism to collapse the film web width so that the web edges are formed into rope configurations connected by a membrane of film. The carriage is driven along the frame in one direction to provide a wrap, stops when the sensing mechanism on the carriage indicates that a junction between units on the load is present to deposit the stretched collapsed film web so that each roped edge is placed on an adjoining vertically positioned unit with the membrane connecting the two units. The carriage carries the film roll to the next or subsequent junctions where the wrap cycle is repeated until the package wrap is complete, at which time the material web is severed from the material roll dispenser.

U.S. Pat. No. 4,754,594 to Lancaster describes a wrapping apparatus having a frame, a reciprocally driven carriage moveably mounted on the frame, the carriage being adapted to hold a rotatable roll of stretchable film material and a film width varying mechanism. A driven rotatable turntable adapted to support a load is positioned adjacent to the frame, and the leading edge of the film material is held adjacent the load. A brake is connected to the film roll to restrict movement of the web of material from the roll and the film width varying mechanism is mounted in the material path so that the film web travels though a pivotable "C" shaped assembly of the film width varying mechanism to collapse the film web width so that the web edges are formed into rope configurations connected by a membrane of film. The carriage is driven along the frame in one direction to provide a wrap, stops when the sensing mechanism on the carriage indicates that a junction between units on the load is present to deposit the stretched collapsed film web so that each roped edge is placed on an adjoining vertically positioned unit with the membrane connecting the two units. The carriage carries the film roll to the next or subsequent junctions where the wrap cycle is repeated until the package wrap is complete, at which time the material web is severed from the material roll dispenser.

U.S. Pat. No. 4,255,918 to Lancaster et al. describes a wrapping apparatus having a frame, a reciprocally driven carriage moveably mounted on the frame, the carriage being adapted to hold a rotatable roll of stretchable film material and a film width varying mechanism. A driven rotatable turntable adapted to support a load is positioned adjacent to the frame, and the leading edge of the film material is held adjacent the load. A brake is connected to the film roll to restrict movement of the web of material from the roll and the film width varying mechanism is mounted in the material path so that the film web travels through a pivotable "C" shaped assembly of the film width varying mechanism which when pivoted by spring action reduces the film web width, so that the film material is stretched and reduced in width as it leaves the roll. The carriage is driven along the frame in one direction to provide a wrap for a load and returns in an opposite direction while continuing to wrap the load, at which time the material web is severed from the material roll dispenser.

U.S. Pat. No. 4,235,062 to Lancaster, III et al. describes a process for automatically making a spiral wrapped unitary package with a single web of stretchable material to form a netting overwrap. A series of loads, each containing a plurality of units are fed one at a time onto a turntable adjacent a film dispenser with the leading edge of the film from the film dispenser being collapsed in width and held by a clamp mechanism mounted on the turntable. The collapsed film web is spirally wrapped around the load to one end of the load and spirally wrapped around the load to the other end to complete a first cycle defining an overwrap netting configuration with a plurality of symmetrical angular spaces. The turntable is then rotated at least 90° to offset the collapsed film web and a second cycle is repeated with the film web being spirally wrapped to overlie part of the originally spirally wrapped film web and reduce the angularly shaped spaces formed by the first cycle. On the return of the collapsed film web is tucked under a portion of the collapsed film wrapped around the load.

U.S. Pat. No. 4,204,377 to Lancaster et al. describes an apparatus and process for automatically making spiral wrapped unitary package having a netting overwrap. In the apparatus a series of loads, each containing a plurality of units are fed one at a time onto a turntable adjacent a netting dispenser with the leading edge of the netting from the netting dispenser being held by a clamp mechanism mounted on the turntable. The netting is spirally wrapped around the load and is then formed into a rope-like configuration by a roper mechanism, with the roped netting being wrapped around the turntable clamp mechanism, at which time the roped netting is clamped by a clamping, tucking and cutting mechanism. The clamping, tucking and cutting mechanism tucks the portion of the roped wrap between the load and the roped netting wrapped around the clamp mechanism and severs the roped netting as the turntable clamp mechanism is retracted below the edge of the turntable causing the roped overwrap to attempt to return to its memory position, holding the severed end of the roped netting in a fixed position as the clamping, tucking and cutting mechanism is raised out of the contracting roped wrap. The new leading edge of the netting is held by the clamping, tucking and cutting mechanism which carries the leading edge back towards the turntable clamp mechanism allowing the netting to be clamped by the turntable clamp for the next operation, at which time the clamping, tucking and cutting mechanism releases the new leading edge of the netting and is removed from the netting dispensing path.

Notwithstanding the prior art, the present invention is neither taught nor rendered obvious thereby.

SUMMARY OF INVENTION

The present invention is a stretch wrap rope converter and wrapping system wherein the film is converted from sheet to rope before engaging loads to be wrapped. The present invention includes: a.) a wrapping apparatus, the wrapping apparatus having: (i) a frame with a vertical vector for movement of a carriage thereon; (ii) the carriage moveably mounted to the frame for reciprocal movement along the vertical vector; (iii) drive means connected to the carriage for the movement of the carriage, the carriage adapted to hold at least one rotatable roll of stretchable film material thereon and being adapted to generate two separate streams of film therefrom, being a first stream of film and a second stream of film; (iv) a stretch wrap rope converter functionally connected to the carriage so as to receive the first stream of film and the second stream of film, the converter having a first orifice for receiving the first stream of film and for diminishing the width of the first stream of film to create a first rope, and having a second orifice for receiving the second stream of film and for diminishing its width to create a second rope, the converter further including rope rotation means so as to rotate the first orifice and the second orifice through an arc in at least one of a reciprocal fashion and a circular fashion to cause the first rope and the second rope to move toward and then away from one another; and b.) wrapping target rotation means adapted to rotate at least one of the wrapping apparatus and a wrapping target so that the first rope and the second rope engage the wrapping target during rotation.

In some preferred embodiments of the present invention, the stretch wrap rope converter and wrapping system has an arc that is greater than 90 degrees so as to cause the first rope and the second rope to cross over one another during rotation of the wrapping target rotation means.

In some preferred embodiments of the present invention, the stretch wrap rope converter and wrapping system first orifice and the second orifice have a fixed orifice size.

In some preferred embodiments of the present invention, the stretch wrap rope converter and wrapping system first orifice and the second orifice have adjustable orifice sizes.

In some preferred embodiments of the present invention, the stretch wrap rope converter and wrapping system has rope rotation means that has a fixed speed of rotation.

In some preferred embodiments of the present invention, the stretch wrap rope converter and wrapping system has rope rotation means that has an adjustable speed of rotation.

In some preferred embodiments of the present invention, the stretch wrap rope converter and wrapping system wrapping target rotation means is a frame rotation means adapted to move the frame around a wrapping target.

In some preferred embodiments of the present invention, the wrapping target rotation means is a target rotation means that includes a base that rotates a target in the base relative to the frame.

In some preferred embodiments of the present invention, the rope rotation means is adapted to rotate reciprocally through the arc on a rope rotation means controller that is adapted to create rotation selected from the group consisting of continuous, intermittent and combinations affording a choice of each.

In some preferred embodiments of the present invention, the stretch wrap rope converter and wrapping system carriage is adapted to hold one notable roll of stretchable film material and includes a slitting mechanism to slit stretchable film material into the two streams of film.

In other embodiments of the present invention stretch wrap rope converter and wrapping system, the system includes: a.) a wrapping apparatus, the wrapping apparatus having: (i) a frame with a vertical vector for movement of a carriage thereon; (ii) the carriage moveably mounted to the frame for reciprocal movement along the vertical vector; (iii) drive means connected to the carriage for the movement of the carriage, the carriage adapted to hold at least one rotatable roll of stretchable film material thereon and being adapted to generate two separate streams of film therefrom, being a first stream of film and a second stream of film; (iv) a stretch wrap rope converter functionally connected to the carriage so as to receive the first stream of film and the second stream of film, the converter having a first orifice for receiving the first stream of film and for diminishing the width of the first stream of film to create a first rope, and having a second orifice for receiving the second stream of film and for diminishing its width to create a second rope, the converter further including rope rotation means so as to rotate the first orifice and the second orifice through an arc in at least one of a reciprocal fashion and a circular fashion to cause the first rope and the second rope to move toward and then away from one another; b.) wrapping target rotation means adapted to rotate at least one of the wrapping apparatus and a wrapping target so that the first rope and the second rope engage the wrapping target during rotation; c.) a computer control subsystem connected to the carriage, the stretch wrap rope converter and the wrapping target rotation means so as to coordinate simultaneous movement of the carriage reciprocally on the frame, movement of the first film and second film through the orifices, rotation of the converter reciprocally about the arc and movement of the wrapping target rotation means. Further all of the other features and preferences described above in this section apply to these embodiments as well.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

The present invention stretch wrap rope converter and wrapping system permits the use of stretch wrap sheets to be converted to rope and presents the user with opportunities to wrap loads in criss-cross fashion with the converted ropes, wherein the degree of separation between crossing ropes can be altered and the heights between complete circles of rope can also be adjusted.

Figure 1:
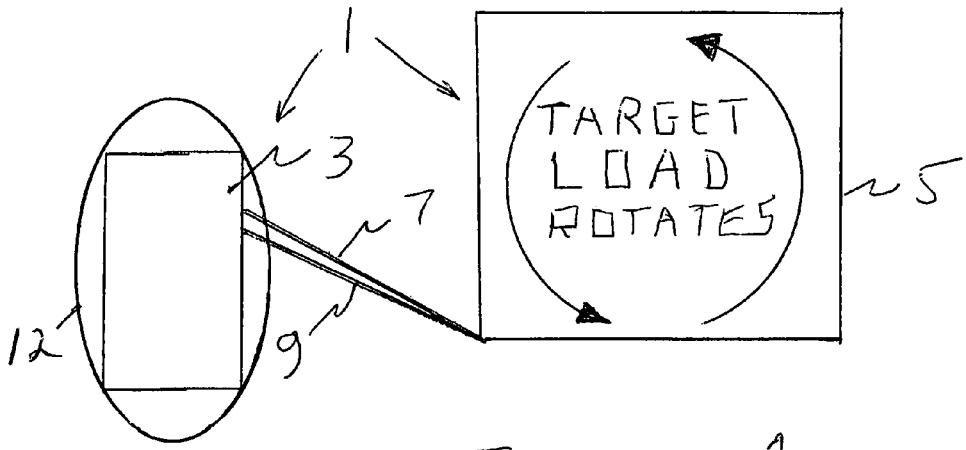
FIG. 1 is a top view of a diagrammatic representation of one embodiment of the present invention.
Figure 2:
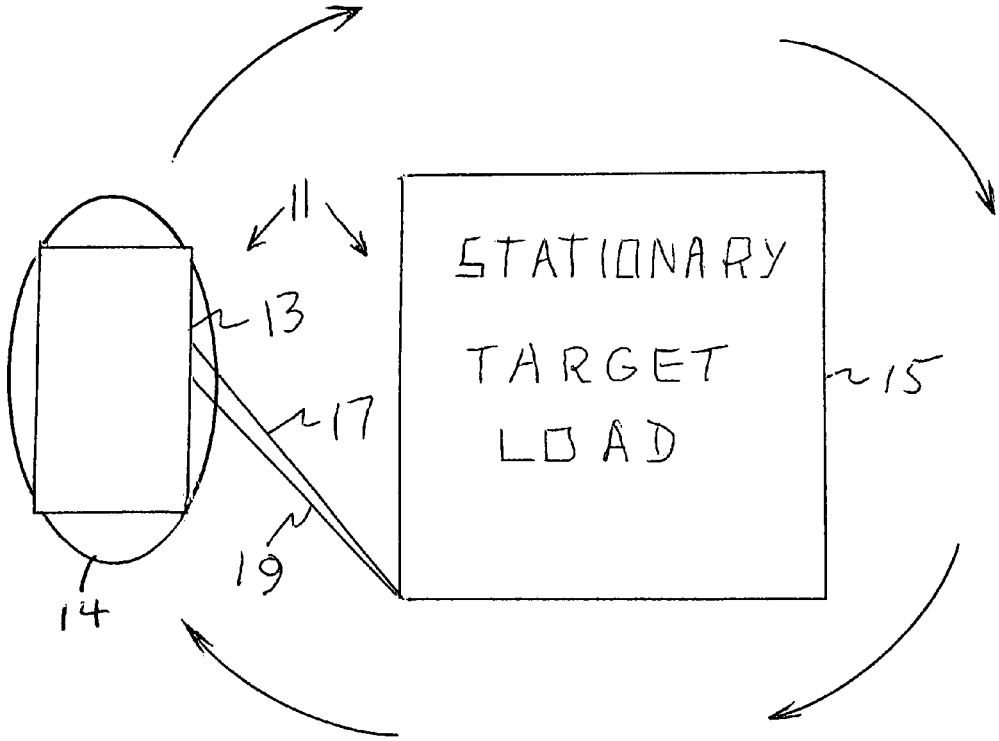
FIG. 2 is a top view of a diagrammatic representation of another embodiment of the present invention.

FIG. 1 and FIG. 2 are top views of diagrammatic representations of two different embodiments of the present invention a stretch wrap rope converter and wrapping system, simply illustrating the two different manners in which the stretch wrap rope converter and the load being wrapped may move relative to one another.

In FIG. 1, system 1 is shown wherein the present invention wrapping device 3 provides two interacting stretch wrap ropes 7 and 9 being wrapped around load 5. Wrapping device 3 is stationary on support carriage 12, and, from this top view, it can be seen that the target load 5 is rotated to achieve the wrapping. This is accomplished by a rotating base or turntable upon which the target load 5 is set. The raising and lowering of the rope to move up and down the load to wrap may be achieved by raising and lowering device 3, raising and lowering target load 5, or a combination thereof.

In FIG. 2, the opposite arrangement from FIG. 1 is shown and may be preferred for large or heavy target loads. Thus, in FIG. 2, system 11 is shown wherein the present invention wrapping device 13 provides two interacting stretch wrap ropes 17 and 19 being wrapped around load 15, the details of which are illustrated in the Figures below. Here, target load 15 is stationary and, from this top view, it can be seen that the present invention wrapping device 13 is supported for vertical and horizontal movement on support carriage 14, which is rotated to achieve the wrapping. This is accomplished by rotating the present invention wrapping device base around a track or path that circumvents the target load 15. The raising and lowering of the rope to move up and down the load to wrap may be achieved by raising and lowering device 13, raising and lowering target load 15, or a combination thereof.

Figure 3:
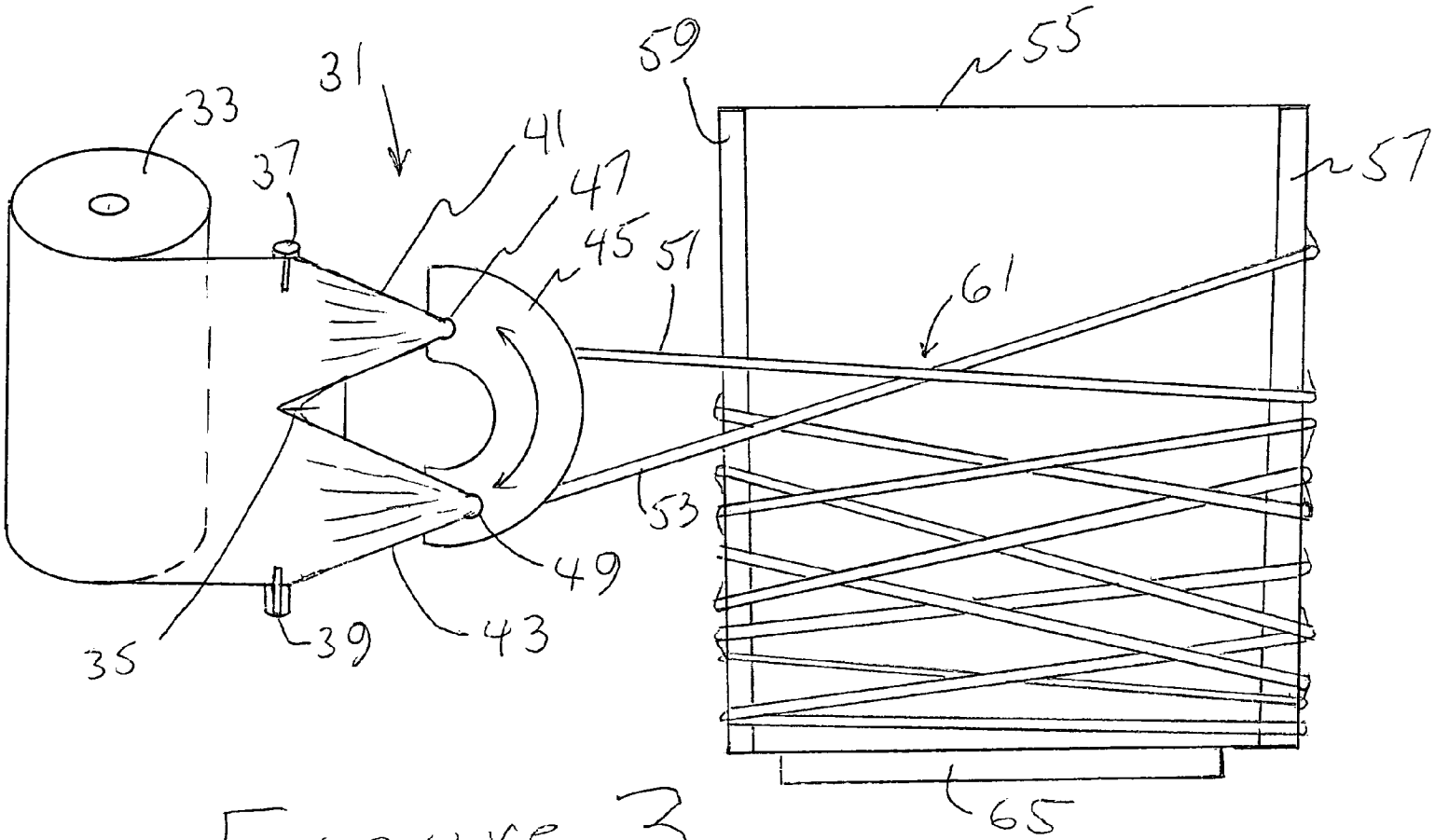
FIG. 3 is a side view of one preferred embodiment of a stretch wrap rope converter and wrapping system according to the present invention.

FIG. 3 is a side view of one preferred embodiment of a stretch wrap rope converter and wrapping system 31 according to the present invention. A single roll 33 of stretch wrap feeds to a guide bar with top guide 37 and bottom guide 39. About midpoint therebetween is sheet slitter 35 that cuts the sheet into two separate sheets 41 and 43. Sheet 41 feeds through a first orifice 47 on rope converter 45, and sheet 43 feeds through second orifice 47 on rope converter 45. The sheet 41 is converted to rope 51 and sheet 43 is converted to rope 53 as each passes through rope converter 45. Rope converter 45 moves reciprocally through an arc and thus the ropes 51 and 53 are repeatedly crossing one another such as at intersection 61, to bind load 55. Corner inserts 57 and 59 are provided to protect the corners of load 55 while being wrapped and while in transit. The length of the arc may be adjusted to make wider or narrower distances between each of the ropes and its speed may be adjusted as well. Spacing between each wrap around the load 55 may be adjusted by the rise rate of the supporting carriage of the device and the speed of the turntable 65 upon which load 55 is rotated. (In this Figure, a supporting carriage is not shown, to simplify the illustration of the functionality of the rope converter 45, but the carriages permit the present invention wrapping devices to be controllably moved through a vertical vector, and one is shown in conjunction with FIG. 6, below).

Figure 4:
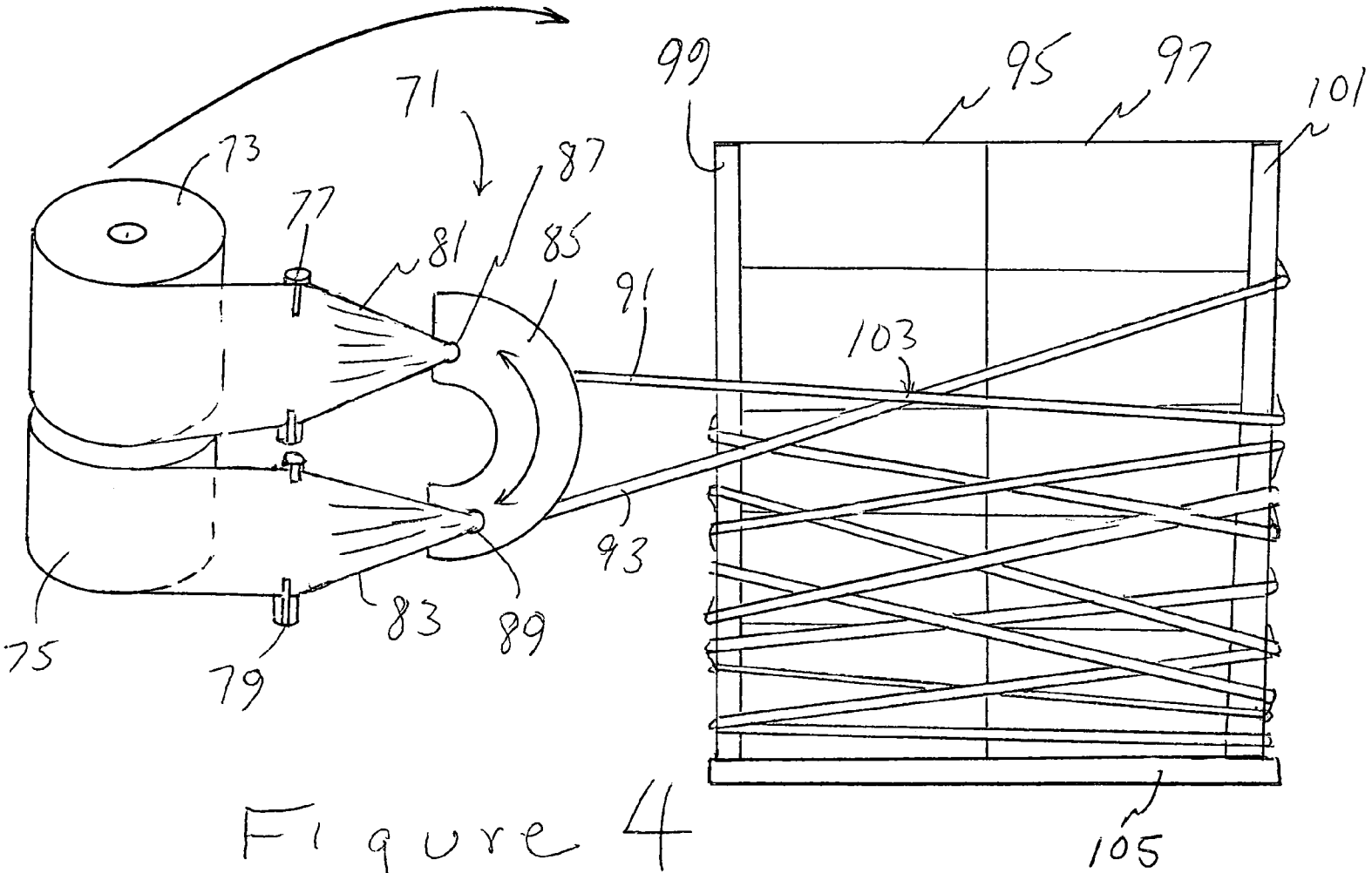
FIG. 4 is a side view of another preferred embodiment of a stretch wrap rope converter and wrapping system according to the present invention.

FIG. 4 is a side view of another preferred embodiment of a stretch wrap rope converter and wrapping system 71 according to the present invention. In this embodiment, the wrapping device travels around the load. Two separate rolls 73 and 75 of stretch wrap feed to separate guide bars 77 and 79. Because two separate rolls are used here, there is no need for a sheet slitter. Sheet 81 feeds through a first orifice 87 on rope converter 85, and separate sheet 83 feeds through second orifice 87 on rope converter 85. The sheet 81 is converted to rope 91 and sheet 83 is converted to rope 93 as each passes through rope converter 85. Rope converter 85 moves reciprocally through an arc and thus the ropes 91 and 93 are repeatedly crossing one another such as at intersection 103, to bind the load made up of stacked boxes, such as boxes 95 and 97, on pal let 105. Corner inserts, such as inserts 99 and 101 are provided to protect the corners of the target load while being wrapped and while in transit. The length of the arc may be adjusted to make wider or narrower distances between each of the ropes and its speed may be adjusted as well. Spacing between each wrap around the load may be adjusted by the rise rate of the supporting carriage (not shown) of the device and the speed of the carriage upon which the wrapping device with the converter 85 and rolls 73 and 75 are rotated around the load.

Figure 5:
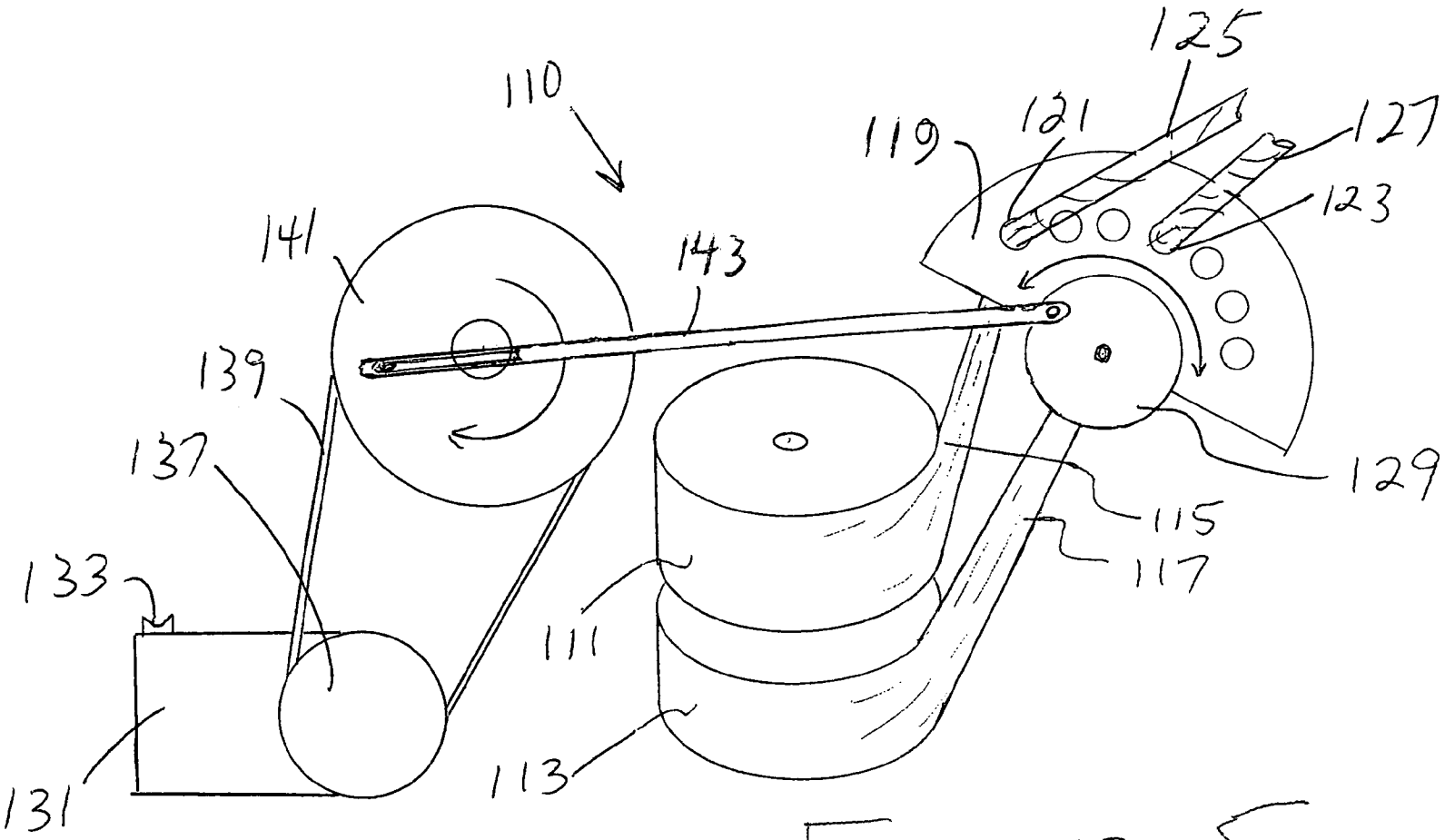
FIG. 5 is a partial side view of another preferred embodiment of a stretch wrap rope converter and wrapping system according to the present invention; and, FIG. 6 is a side view of another preferred embodiment of a stretch wrap rope converter and wrapping system according to the present invention.

FIG. 5 is a partial side view of another preferred embodiment of a stretch wrap rope converter and wrapping system 110 illustrating one type of mechanical drive system for the converter. Other types of drive systems are within the skill of the artisan now that the present invention has been shown. Thus, the present invention should not be seen as limited to the FIG. 5 mechanical drive system. (FIG. 6, below, illustrates another type of drive system. Others could be electronic drive systems.)

FIG. 5 shows two separate stretch wrap rolls 111 and 115, but it could alternatively be a single roll with one or more slitters. These rolls have sheets 115 and 117 respectively fed (pulled) through converter orifices 121 and 123 on converter 119 to become ropes 125 and 127. Converter 119 is attached to a drive wheel 129, that is moved through an arc via drive rod 143. Because drive rod 143 is rotatably attached to wheel 129 and is slideably attached to drive wheel 141, it will move only through an arc and not a full circle at converter 129, thus creating the type of rope wrapping shown in the last two Figures.

Figure 6:
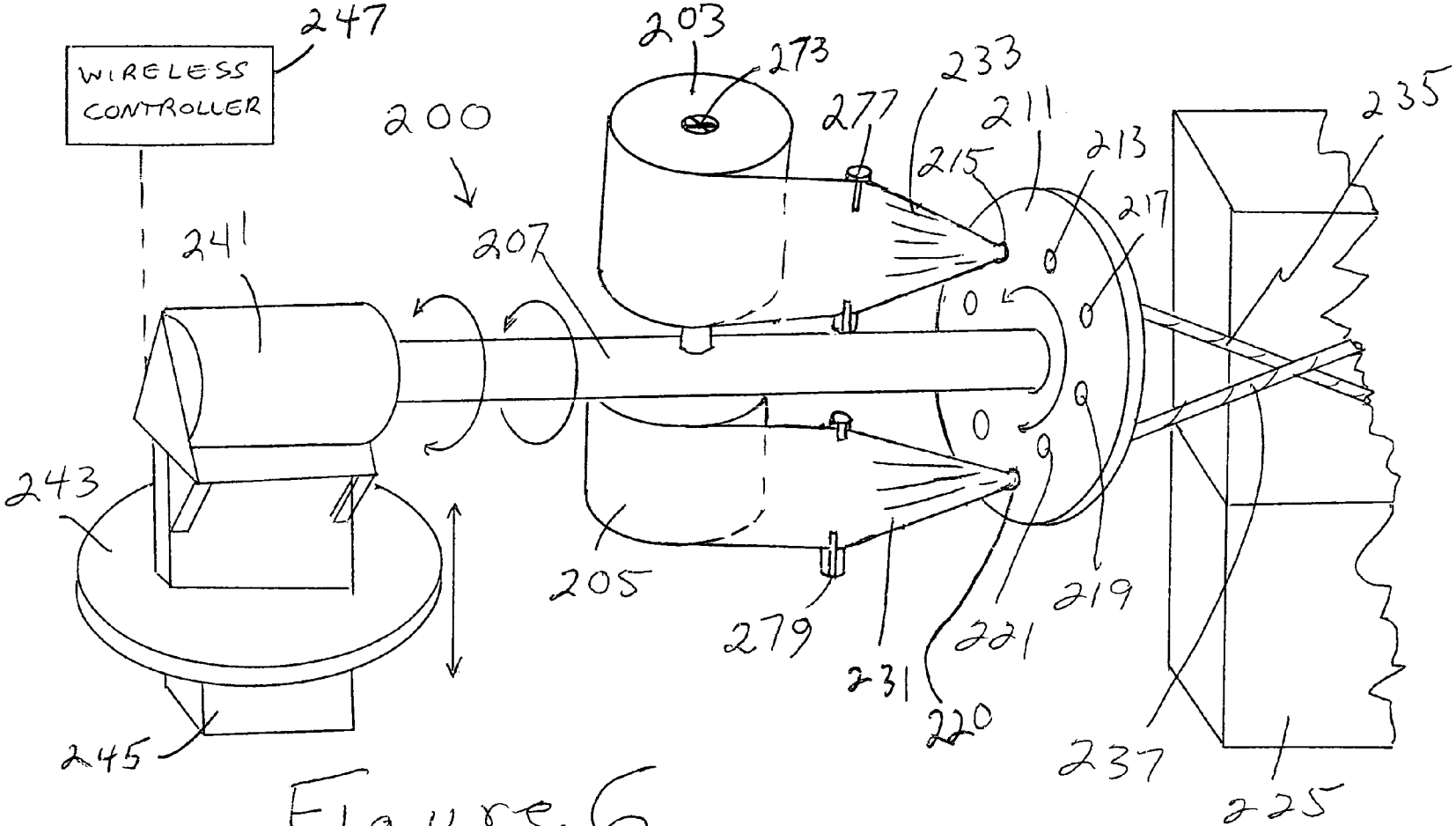

FIG. 6 is a side perspective view of another preferred embodiment of a stretch wrap rope converter and wrapping system 200 according to the present invention. Carriage base 245 raises and lowers carriage 243 along a vertical vector as it revolves around the load, the load rotates on a turntable, or both. Drive motor 241 may be programmed, or remotely controlled with wireless controller 247, to rotate drive axle 207 or to reciprocally move drive axle 207 through an arc to simultaneously rotate or move through the arc, the rolls and converter to the right thereof. That is, stretch wrap roll 203 on axle 273 and stretch wrap roll 205 on its axle (not shown), along with guides 277 and 279, and converter 211 follow the path of drive axle 207. The sheets 233 and 231 respectively pass through converter 211 at orifices 215 and 220 respectively. They are converted to rope, and the tightness or rough rope diameter can be adjusted by adjusting the orifice size or offering different size orifices on the converter or different converter plates with different orifice sizes. Likewise, the spacing of the orifices will, in part, determine the spacing of the ropes on the load. Hence, on this converter 211, orifices such as orifices 213, 215, 217, 219, 220 and 221 are presented. The resulting ropes 235 and 237 are crossed and wrap load 225, as shown.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A stretch wrap rope converter and wrapping system, which comprises:

a.) a wrapping apparatus, said wrapping apparatus having:

(i) a frame with a vertical vector for movement of a carriage thereon;

(ii) said carriage moveably mounted to said frame for reciprocal movement along said vertical vector;

(iii) drive means connected to said carriage for said movement of said carriage, said carriage adapted to hold at least one rotatable roll of stretchable film material thereon and being adapted to generate two separate streams of film therefrom, being a first stream of film and a second stream of film;

(iv) a stretch wrap rope converter functionally connected to said carriage so as to receive said first stream of film and said second stream of film, said converter having a first orifice for receiving said first stream of film and for diminishing the width of said first stream of film to create a first rope, and having a second orifice for receiving said second stream of film and for diminishing its width to create a second rope, said converter further including rope rotation means so as to rotate said first orifice and said second orifice through an arc in at least one of a reciprocal fashion and a circular fashion to cause said first rope and said second rope to move toward and then away from one another;

b.) wrapping target rotation means adapted to rotate at least one of said wrapping apparatus and a wrapping target so that said first rope and said second rope engage said wrapping target during rotation.

2. The stretch wrap rope converter and wrapping system of claim 1 wherein said arc is greater than 90 degrees so as to cause said first rope and said second rope to cross over one another during rotation of said wrapping target rotation means.

3. The stretch wrap rope converter and wrapping system of claim 1 wherein said first orifice and said second orifice have a fixed orifice size.

4. The stretch wrap rope converter and wrapping system of claim 1 wherein said first orifice and said second orifice have adjustable orifice sizes.

5. The stretch wrap rope converter and wrapping system of claim 1 wherein said rope rotation means has a fixed speed of rotation.

6. The stretch wrap rope converter and wrapping system of claim 1 wherein said rope rotation means has an adjustable speed of rotation.

7. The stretch wrap rope converter and wrapping system of claim 1 wherein said wrapping target rotation means is a frame rotation means adapted to move said frame around a wrapping target.

8. The stretch wrap rope converter and wrapping system of claim 1 wherein said wrapping target rotation means is a target rotation means that includes a base that rotates a target in said base relative to said frame.

9. The stretch wrap rope converter and wrapping system of claim 1 wherein said rope rotation means is adapted to rotate reciprocally through said arc on a rope rotation means controller that is adapted to create rotation selected from the group consisting of continuous, intermittent and combinations affording a choice of each.

10. The stretch wrap rope converter and wrapping system of claim 1 wherein said carriage is adapted to hold one notable roll of stretchable film material and includes a slitting mechanism to slit stretchable film material into said two streams of film.

11. A stretch wrap rope converter and wrapping system, which comprises:

a.) a wrapping apparatus, said wrapping apparatus having:

(i) a frame with a vertical vector for movement of a carriage thereon;

(ii) said carriage moveably mounted to said frame for reciprocal movement along said vertical vector;

(iii) drive means connected to said carriage for said movement of said carriage, said carriage adapted to hold at least one rotatable roll of stretchable film material thereon and being adapted to generate two separate streams of film therefrom, being a first stream of film and a second stream of film;

(iv) a stretch wrap rope converter functionally connected to said carriage so as to receive said first stream of film and said second stream of film, said converter having a first orifice for receiving said first stream of film and for diminishing the width of said first stream of film to create a first rope, and having a second orifice for receiving said second stream of film and for diminishing its width to create a second rope, said converter further including rope rotation means so as to rotate said first orifice and said second orifice through an arc in at least one of a reciprocal fashion and a circular fashion to cause said first rope and said second rope to move toward and then away from one another;

b.) wrapping target rotation means adapted to rotate at least one of said wrapping apparatus and a wrapping target so that said first rope and said second rope engage said wrapping target during rotation;

c.) a computer control subsystem connected to said carriage, said stretch wrap rope converter and said wrapping target rotation means so as to coordinate simultaneous movement of said carriage reciprocally on said frame, movement of said first film and second film through said orifices, rotation of said converter reciprocally about said arc and movement of said wrapping target rotation means.

12. The stretch wrap rope converter and wrapping system of claim 11 wherein said arc is greater than 90 degrees so as to cause said first rope and said second rope to cross over one another during rotation of said wrapping target rotation means.

13. The stretch wrap rope converter and wrapping system of claim 11 wherein said first orifice and said second orifice have a fixed orifice size.

14. The stretch wrap rope converter and wrapping system of claim 11 wherein said first orifice and said second orifice have adjustable orifice sizes.

15. The stretch wrap rope converter and wrapping system of claim 11 wherein said rope rotation means has a fixed speed of rotation.

16. The stretch wrap rope converter and wrapping system of claim 11 wherein said rope rotation means has an adjustable speed of rotation.

17. The stretch wrap rope converter and wrapping system of claim 11 wherein said wrapping target rotation means is a frame rotation means adapted to move said frame around a wrapping target.

18. The stretch wrap rope converter and wrapping system of claim 11 wherein said wrapping target rotation means is a target rotation means that includes a base that rotates a target in said base relative to said frame.

19. The stretch wrap rope converter and wrapping system of claim 11 wherein said rope rotation means is adapted to rotate reciprocally through said arc on a rope rotation means controller that is adapted to create rotation selected from the group consisting of continuous, intermittent and combinations affording a choice of each.

20. The stretch wrap rope converter and wrapping system of claim 11 wherein said carriage is adapted to hold one notable roll of stretchable film material and includes a slitting mechanism to slit stretchable film material into said two streams of film.

* * * * *